United States Patent [19]

Gardner

[11] 3,985,271

[45] Oct. 12, 1976

[54] FOAM GENERATING AND DISPENSING DEVICE

[75] Inventor: Jack C. Gardner, College Park, Ga.

[73] Assignee: Glasrock Products, Inc., Atlanta, Ga.

[22] Filed: June 6, 1975

[21] Appl. No.: 584,610

[52] U.S. Cl. ..... 222/190; 222/211; 239/343

[51] Int. Cl.[2] ..... B65D 37/00

[58] Field of Search ..... 239/343, 340; 222/211, 222/212, 190, 187, 189

[56] References Cited

UNITED STATES PATENTS

| | | | |
|---|---|---|---|
| 1,896,624 | 2/1933 | Hollands | 239/343 X |
| 2,577,321 | 12/1951 | Filger | 222/206 X |
| 2,680,010 | 6/1954 | Dubay | 261/124 |
| 3,308,993 | 3/1967 | Bruno | 239/343 X |
| 3,422,993 | 1/1969 | Boehm et al. | 222/190 |
| 3,428,222 | 2/1969 | Wright | 222/187 |
| 3,622,049 | 11/1971 | Thompson | 239/343 X |
| 3,709,437 | 1/1973 | Wright | 239/343 |
| 3,937,364 | 2/1976 | Wright | 222/190 |

*Primary Examiner*—John J. Love
*Assistant Examiner*—Michael Mar
*Attorney, Agent, or Firm*—Lane, Aitken, Dunner & Ziems

[57] ABSTRACT

A foam generating and dispensing device in the form of a cap assembly adapted to be fitted to the mouth of a collapsible bottle formed of resilient material and in which the structural assembly of cap components is effected by an integral molded porous element of rigid polymeric material. A one-way valve is provided by a ball check seatable in a passage through the porous element to enable a rapid return of air to the bottle interior for recovery thereof after forceful collapse for the discharge of foam. In an alternative embodiment, the one-way valve is provided by an elastomeric sleeve circumscribing an interior extension of the discharge passage and overlying an aperture therein.

12 Claims, 6 Drawing Figures

FIG. 1.
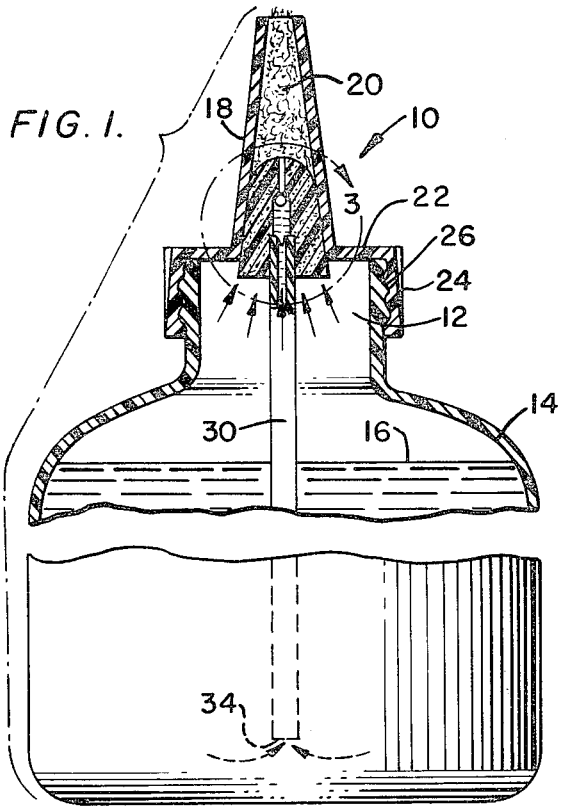
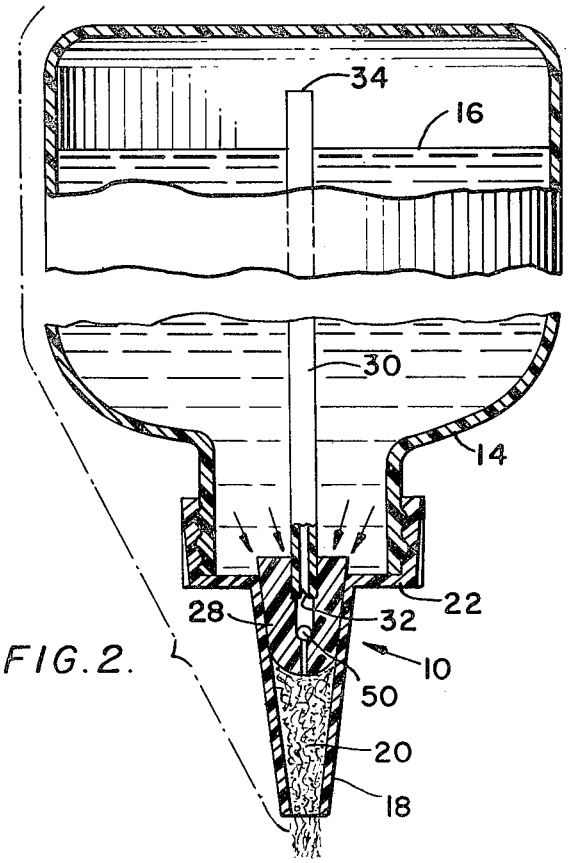
FIG. 2.
FIG. 3.
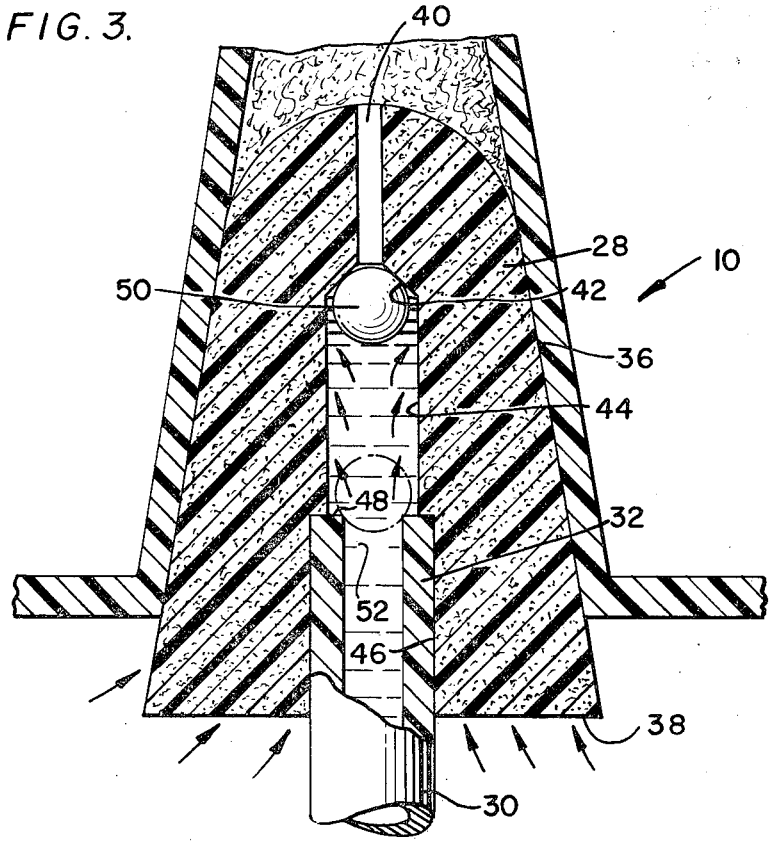

FOAM GENERATING AND DISPENSING DEVICE

BACKGROUND OF THE INVENTION

This invention relates to foam dispensers and more particularly, it concerns improvements in foam generating and dispensing devices generally constituted by a cap assembly attachable to a collapsible receptacle or bottle containing a formable liquid and air such that upon forced collapse of the bottle walls, a mixture of air and liquid is dispensed as foam through an outlet nozzle in the cap assembly.

The prior art relating to foam dispensers is quite highly developed as demonstrated by the numerous patents and published disclosures as well as by the vast array of commercially available foam product dispensers. In general, such foaming devices may be characterized as falling in one of two basic types; namely, foam dispensing devices which carry a supply of pressurized gas to be mixed with the foamable liquid or manually actuated devices in which the pressure required to dispense foam is developed by collapsing a resilient receptacle or syringe-type pumping device. The present invention is concerned principally though not exclusively with foam dispensing devices of this latter or manually actuated type.

The functional components required for satisfactory operation of manually actuated foam generating and dispensing devices are well known. In addition to the collapsible bottle and discharge nozzle establishing cap assembly, provision must be made for mixing air and foamable liquid under conditions which will produce foam of predictably uniform consistency on forced collapse of the bottle to discharge foam through the nozzle. It is well known in the prior art that such conditions are established by discharging the air and formable liquid through a porous element of sponge-like material providing minute tortuous passages in which highly turbulent flow of the liquid and air effect the appropriate mixing and homogenization of the discharged foam. See, for example, U.S. Pat. No. 2,680,010 issued June 1, 1954 to F. X. Dubay; U.S. Pat. No. 3,422,993 issued Jan. 21, 1969 G. L. Boehm et al. and U.S. Pat No. 3,709,437 issued Jan. 9, 1973 to H. E. Wright.

Although such prior foam generating and dispensing devices have shown promise, their incorporation as cap assemblies for collapsible bottles have presented obstacles to widespread commerical use in part because of excessive manufacturing costs relative to the cost of competing alternatives and in the achievement of rapid recovery of the bottle or receptacle for containing the foamable liquid and air after forced collapse for the discharge of foam through the nozzle of the cap assembly. The excessive costs are believed due primarily to the number of individual parts which have been required in prior devices as well as the time involved in their assembly. The achievement of rapid recovery of the bottle after forced collapse thereof is deterred also in good measure by unwanted manufacturing costs inasmuch as acceptable recovery rates require a provision for one-way valving to allow for the free return of air to the bottle interior without impairing pressurized containment of the air for the foam generating and discharging operation. Because of these and other problems associated with manually actuated foam generating and discharging devices, there has been a trend in the industry to the use of more expensive devices, of the type in which a supply of pressurized gas is carried in the receptacle of foamable liquid with the added costs being passed onto the consumer.

SUMMARY OF THE PRESENT INVENTION

In accordance with the present invention, a highly effective and yet extremely low-cost manually actuated foam generating and dispensing device is provided by a cap assembly adapted to be used with conventional collapsible bottles and in which structural integration of the assembly is effected in substantial measure by a rigid porous polymeric structure which serves also the mixing and homogenizing functions required for the conversion of the foamable liquid and air to a dispensed foam of uniform consistency. In a preferred form, the rigid porous element, in addition to serving the mixing and homogenizing functions, serves not only as a single structural component for coupling a dip tube with the discharge nozzle of a conventional cap but also as a valve seat and passage for a one-way air return valve. In alternative embodiments, the porous element couples a dip tube or its equivalent directly with an interior extension of the cap discharge nozzle or passage, the one-way valve provision being accommodated by an elastomeric sleeve overlying a by-pass aperture in the interior extension. Also it is contemplated that the invention will have application to foam generating and dispensing devices in which the collapsible receptacle containing the foamable liquid is either maintained in an upright position or inverted for manual collapse to discharge the foam.

Among the objects of the present invention are: the provision of a highly effective foam generating and dispensing cap assembly for attachment directly to a collapsible bottle containing foamable liquid and air; the provision of such a foam generating and dispensing device having a minimum number of component parts; the provision of such a foam generating and dispensing cap assembly for collapsible bottles which is adaptable for foam dispensing by inversion of the collapsible bottle or by collapsing the bottle in an upright position; the provision of such a cap assembly in which a rigid porous member for mixing and homogenizing foamable liquid and air functions also as an integral structural component in the assembly; and the provision of a manually actuated foam generating and dispensing device by which manufacturing costs are reduced to an absolute minimum without sacrifice of operating efficiency.

Other objects and further scope of applicability of the present invention will become apparent from the detailed description to follow taken in conjunction with the accompanying drawings in which like reference numerals designate like parts.

BRIEF DESCRIPTION OF THE DRAWINGS

FIG. 1 is a fragmentary elevation in partial section illustrating a preferred embodiment of the present invention;

FIG. 2 is a fragmentary cross-section of the device illustrated in FIG. 1 depicting its operation in an inverted condition;

FIG. 3 is a blow-up of the portion circumscribed by the line 3 in FIG. 1;

DETAILED DESCRIPTION OF THE PREFERRED EMBODIMENTS

Figure 4:
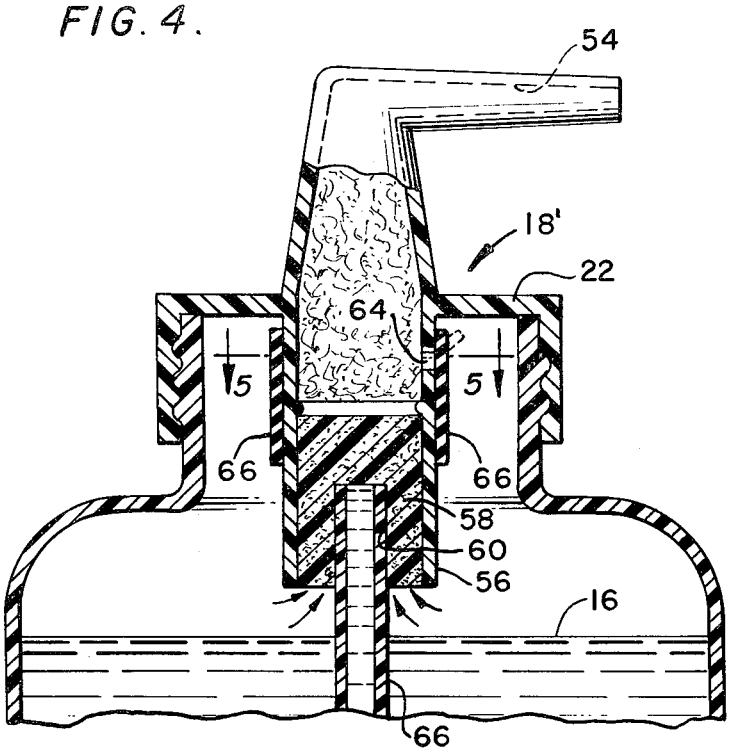
FIG. 4 is a fragmentary cross-section illustrating the operative components of an alternative embodiment of the invention.

In FIGS. 1–3 of the drawings, a preferred embodiment of the present invention is shown to include a cap assembly, generally designated by the reference numeral 10, fixed to the mouth 12 of a conventional bottle 14 formed of resilient impervious material such as polyethylene, polyvinyl chloride, rubber or any of an assortment of such materials. The bottle is shown to be filled partially with a foamable liquid 16 with the remaining space being occupied by air. Though it is apparent that the heavier foamable liquid 16 will be disposed at the bottom of the bottle and that the lighter air will occupy the space near the top of the bottle, is equally apparent that the respective locations of the liquid and air in the bottle will be reversed upon inversion of the bottle 14. To accommodate the ensuring description of the various embodiments of the present invention and their operation in use, the term "vertical extremity" is intended to denote either the bottle top or bottom, it being understood that the liquid 16 will be situated at one such vertical extremity whereas the air filling the remainder of the interior bottle space will be disposed at the opposite such vertical extremity.

The cap assembly 10 includes a one-piece cap element 18 which may be formed from the same material as that from which the bottle 14 is formed though without requirement for its being capable or resilient deformation. The element 18 includes a tubular formation to define a convergent or conical nozzle-like discharge passage 20 opening through an annular closure portion 22 from which an internally threaded skirt 24 depends for engagement with external threads 26 at the bottle mouth 12. A rigid porous element 28, to be described in more detail below, is fitted in the base of the discharge passage 20 and supports an imperforate dip tube 30 which extends in closed fluid communication from one end 32 in the porous element 28 at one vertical extremity of the bottle to an opposite distal end 34 near the opposite vertical extremity of the bottle 14.

The configuration of the porous element 28, as shown, is generally conical to provide a convergent outer surface 36 which complements the converging inner wall surfaces of the discharge passage 20 to enable securement of the element 28 in the passage 20 solely by friction resulting from pressing the element 28 into the large end of the passage. The conical surface 36 joins at its large or inner end with an annular radial surface or base 38 exposed to the interior of the bottle 14. The element is further formed in the embodiment illustrated in FIGS. 1–3 with a central air return passage 40 extending from the small or outer end of the element 28 to an opening through a conical valve seat 42 and a cylindrical valve chamber 44 to the end 32 of the dip tube. A counterbore 46 extends from the base 38 of the porous element to the valve chamber 44 and is of a diameter providing a close fit with the exterior of the dip tube so that the end 32 may be secured in the counterbore 46 solely by the friction resulting from a press fit of the dip tube into the counterbore. As shown most clearly in FIG. 3, the relative diameters of the valve chamber 44 and the counterbore 46 as well as the wall thickness of the dip tube 30 are such that the extreme end 32 of the dip tube establishes an inwardly directed ledge 48 at the end of the valve chamber 44 opposite the seat 42. A ball check 50 of a diameter larger than the inside diameter of the dip tube 30 is positioned in the valve chamber 44 and prevented from sealing the end of the dip tube 30 by suitable end deformation such as a notch 52. It will be appreciated that because of the relative diameters of the ball check 50 and the interior of the dip tube 30, the ball check will not pass through the dip tube. Although the ball check 50 will not seat against the end of the dip tube because of the notch 52, it will engage the seat 42 at the opposite end of the valve chamber to prevent passage of fluid in a direction proceeding from the dip tube through the passage 40.

The embodiment of FIGS. 1–3 is used most satisfactorily with all types of foamable liquids in the inverted position as depicted by FIG. 2 of the drawings. After such inversion to position the liquid 16 to be in contact with the porous element 20, and to position the distal end 34 of the dip tube 30 in air at the opposite vertical extremity of the bottle 14, the bottle is manually collapsed to force the liquid 16 through the body of the porous element 28. Simultaneously, air under pressure as a result of forceable collapse of the bottle walls will pass through the dip tube and into the valve chamber 44. Because the ball check 50 will at this time be engaged with the seat 42 and thus block the passage 40, air will be forced outwardly into the body of the porous element 28 to mix with the liquid therein and be discharged through the discharge passage 20 as foam. Upon release of the collapsing force, the initial conformation of the bottle will be quickly established by the return of air through the passage 40, past the ball check 50 which will be unseated at this time and through the dip tube 30.

As above mentioned, use of this embodiment in the inverted condition is preferred inasmuch as the path for air returning to the bottle is virtually unobstructed. It is possible, however, to achieve the discharge of a foam of uniform consistency where the bottle is collapsed while situated in its upright condition as illustrated in FIG. 1 of the drawings. In this mode of operation, collapse of the bottle will cause the liquid 16 to be passed upwardly through the dip tube 30 and into the body of the porous member 28 as a result of the ball check 50 seating to block the passage 40. Simultaneously, air will be introduced directly into the body of the porous element 28, mixed with the liquid and discharged as foam upwardly through the passage 20. It will be noted that when the bottle is used in the upright condition, the path for air return to the bottle 14 after collapsing deformation thereof will be through the dip tube and the liquid 16. Although the passage for return air in this mode will be essentially unimpeded inasmuch as the air will bubble-up through the liquid 16, in doing so, it is likely to cause unwanted bubbles in the upper portion of the bottle normally occupied by air. When using foamable liquids which have a relatively low surface tension, any bubbles which may form will dissipate with sufficient rapidity that they will present no obstacle to the passage of air directly into the porous member 28 on subsequent foam discharging cycles. With foamable liquids which have relatively high surface tension, however, it is possible that the bubbles formed as a result of return air passing upwardly through the liquid 16 will inhibit the passage of air into the porous member so that a relatively wet form of unpredictable consistency will be discharged. Hence, it will be appreciated that although the structural organization of the embodiment illustrated in FIGS. 1–3 is adaptable to foam generating and dispensing operations with some foamable liquids in the upright position, its use in the inverted position shown in FIG. 2 is preferred inasmuch as operation in this mode is unaffected by the characteristics of the foamable liquid used.

It is important to the practice of the present invention that the material from which the porous element 28 is formed possess sufficient rigidity to retain its assembly with the tapered discharge passage 20 and the dip tube in the embodiment of FIGS. 1–3, for example, and also that it retain the conformation of the valve chamber 44 and valve seat 42 in this embodiment. It is equally important that the material facilitate the use of conventional low-cost molding techniques while at the same time assure achievement of pore sizes within relatively narrow and predictable ranges if desired. In this latter respect, the bubble size in the foam dispensed will vary directly with the mean pore diameter in the element 28. A material particularly well suited to use for the element 28 is a sintered agglomerate of thermoplastic particles of a type currently in use to form writing nibs for pens. Such materials are fully disclosed in co-pending application of Clarence A. Dickey and John E. McDaniel, Ser. No. 336,179 filed Feb. 27, 1973 now U.S. Pat. No. 3,896,196, entitled "Method for Producing Spherical Thermoplastic Particles" and assigned to the assignee of the present invention. Although the disclosure of that application is directed principally to the method for achieving a sintered agglomerate of spherical particles, the disclosure thereof also includes as exemplary prior art, description and illustration of sintered non-spherical thermoplastic particles which, though possessing less desirable characteristics for use in the production of writing nibs, could be used in the porous element of the present invention for economic reasons. The complete disclosure of the aforesaid application is therefore incorporated herein by reference to provide an understanding of the material from which the element 28 is preferably formed.

In light of the disclosure of the aforesaid patent application, further detailed discussion of the material from which the porous element 28 is formed is believed unnecessary herein except to note that the thermoplastic material used may be any one of several resins such as polyethylene, polypropylene, polyvinyl alkalide as well as the polyvinylidine fluoride mentioned in the aforementioned application. Such a rigid and porous polymeric structure may be easily molded to possess a void volume anywhere in the range of between 10% and 90% and a mean pore diameter in the range of between 10 and 500 microns.

Figure 5:
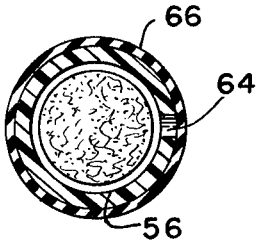
FIG. 5 is a cross-section taken on line 5–5 of FIG. 4.

An alternative embodiment of the present invention is illustrated in FIGS. 4 and 5 of the drawings. In this embodiment, the cap element, designated by the reference numeral 18' is formed with an L-shaped discharge passage 54 which continues through the annular cover portion 22 of the element as a depending interior tube 56 opening near the top of the bottle containing the foamable liquid 16. A porous element of generally cylindrical configuration is press fit within the tube 56 and is provided with a central bore 60 for receiving and supporting the upper end of a dip tube 62. It will be noted that the bore 60 and thus the dip tube terminates at its upper end within the body of the porous element 68 and that the bottom of the porous element is exposed directly to air within the bottle.

The tube 56 is provided with an aperture 64 above the porous element and is circumscribed by an elastomeric sleeve 66 normally covering the aperture 64. In light of this organization it will be appreciated that air in the upper portion of the bottle of the embodiment in FIG. 4 will be prevented from passing through the aperture 64 outwardly through the passage 54 but will be permitted to return through the passage 54 to the bottle interior by deformation of the sleeve in the region of the aperture 64 and as depicted by phantom lines in FIG. 4.

The embodiment of FIGS. 4 and 5 is intended to be used in the upright position such that upon collapse of the bottle containing the foamable liquid 16, liquid will be forced upwardly through the dip tube 62 into the porous member 58. Simultaneously air in the upper portion of the bottle will be forced upwardly through the porous element and mixed with the liquid to be discharged as foam through the passage 54. Rapid recovery of the collapsed bottle to its initial state will be accommodated by the return passage of air through the port 64.

Figure 6:
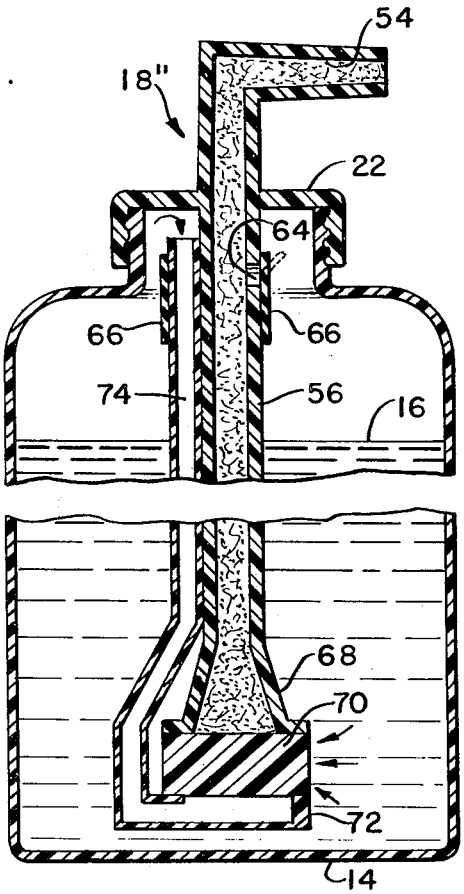
FIG. 6 is a fragmentary cross-section illustrating a further alternative embodiment of the invention.

In FIG. 6 of the drawings, a further alternative embodiment of the invention is shown. In this instance, the nozzle element, designated generally by the reference numeral 18'' is again provided with an L-shaped discharge passage 54 which continues through the annular cap portion 22 as a depending tube 56 having an air return aperture 64 near the upper vertical extremity of the bottle to contain the foamable liquid 16. The tube 56 in this embodiment extends downwardly toward the opposite vertical extremity of the bottle and to a flared foot portion 68 secured such as by bonding or ultrasonic welding to the top surface of a porous element 70. The bottom of the porous element 70 is similarly secured to an enlarged end 72 of a tube 74 extending from the porous element to the opposite vertical extremity of the bottle 14. The elastomeric sleeve 66 in this instance circumscribes both the tube 74 and the tube 56 but functions precisely in the same manner as these components were described to function in the embodiment of FIG. 4.

The operation of the embodiment of FIG. 6, again intended with the bottle 14 in an upright position, is such that the liquid 16 will be forced directly into the porous element 70 and upwardly through the tube 56 after having been mixed with air passing through the tube 74. Air return for restoration of the bottle to its initial condition will be through the port 64 in the manner described above with respect to FIG. 4.

Thus it will be appreciated that by this invention there is provided an unique and highly effective foam generating and dispensing device by which the above mentioned objectives are completely fulfilled. It will be appreciated that various modifications and/or changes may be made in the disclosed embodiments without departure from the inventive concept manifested thereby. It is expressly intended, therefore, that the foregoing description is illustrative of preferred embodiments, not limiting, and that the true spirit and scope of the present invention be determined by reference to the appended claims.

I claim:

1. A foam generating and dispensing device for a collapsible bottle adapted to contain foamable liquid and air, said device comprising:

a cap element tubular formation defining a discharge passage to extend between the interior and exterior of said bottle, said passage having an interior end to be positioned near one vertical extremity of said bottle;

a rigid, polymeric porous member mounted in the interior end of said passage, at least a portion of said porous member being exposed to the bottle interior at said one vertical extremity thereof, said porous member having a longitudinally extending opening defined exclusively by internal surfaces of said porous member;

an imperforate tube terminating at one end extending partially within said longitudinally extending opening of said porous member to be supported by said porous member and opening at its other end near the vertical extremity opposite from said one vertical extremity; and one-way valve means to allow the passage of air from the exterior to the interior of the bottle whereby forced collapse of the collapsible bottle will force both liquid and air through said porous element to generate foam to be discharged from said discharge conduit and restoration of the bottle to its initial conformation will occur due to return of air through said one-way valve means, said one-way valve means being formed by a valve chamber and seat established by the internal surface portions of said porous member defining said longitudinally extending opening, and a ball check movably contained in said valve chamber.

2. The apparatus recited in claim 1 wherein said valve chamber is terminated at one end by said valve seat and at the other end by said one end of said imperforate tube, said one end of said imperforate tube being deformed to prevent fluid closure thereof by said ball check.

3. The apparatus recited in claim 1 wherein said porous member is a molded sintered agglomerate of thermoplastic particles having a void volume of 10% to 90% and a mean pore diameter in the range between 10 and 500 microns.

4. A foam generating and dispensing device for a collapsible bottle adapted to contain foamable liquid and air, said device comprising:

a cap element having tubular formation defining a discharge passage to extend between the interior and exterior of said bottle, said passage having an interior end to be positioned near one vertical extremity of said bottle, said tubular formation extending to the interior of the bottle;

a rigid, polymeric porous member closing the interior end of said passage, at least a portion of said porous member being exposed to the bottle interior at said one vertical extremity thereof;

an imperforate tube supported at one end by said porous member and opening at its other end near the vertical extremity opposite from said vertical extremity; and one-way valve means to allow the passage of air from the exterior to the interior of the bottle whereby forced collapse of the collapsible bottle will force both liquid and air through said porous element to generate foam to be discharged from said discharge conduit and restoration of the bottle to its initial conformation will occur due to return of air through said one-way valve means, said valve means comprising an aperture through said tubular formation on the interior of the bottle outwardly of said porous element and an elastomeric sleeve circumscribing said formation and said aperture to prevent passage of fluid from the interior to the exterior of the bottle through said aperture but to allow the return of air through said aperture by deformation of said sleeve.

5. The apparatus recited in claim 4 wherein said one vertical extremity is located remotely from said discharge passage approximately by the height of the bottle whereby said tubular formation and said imperforate tube both extend to opposite vertical extremities of the bottle from said porous element.

6. A manually actuated foam generating and dispensing device comprising:

a collapsible bottle of impervious resilient material;

a cap element fitted to the mouth of the bottle and having a conical discharge passage opening at its large end to the bottle interior;

a rigid, polymeric porous member also of a conical configuration complementing the interior of said discharge passage and retained therein by a press fit, said porous member having a central passageway defined exclusively by exposed internal surface portions of said porous member to establish a return air passage opening at the small end of said member and extending to an intermediate valve chamber having a valve seat at the end thereof merging with said return passage and joining at its other end with a counterbore extending from said valve chamber to the base end of the porous element;

a movable ball check in said valve chamber; and an imperforate dip tube press fit at one end into said counterbore and extending from said porous element for the approximate interior height of said bottle to an open distal end, the interior diameter of said imperforate tube being smaller than the diameter of said ball check thereby to retain said ball check in said valve chamber.

7. The apparatus recited in claim 6 wherein said one end of said dip tube is notched to prevent seating of said ball check against said dip tube.

8. A foam generating and dispensing device for use with collapsible bottles containing foamable liquid and air, said device comprising:

a cap element adapted to be fitted to the mouth of the bottle and having a discharge passage to open to the bottle interior;

a rigid, polymeric porous member retained in said discharge passage and having inner and outer ends, said porous member having a passageway formed therein to establish a valve chamber having a valve seat at one end thereof and opening at its other end with the inner end of the porous element, at least the portion of said passageway establishing said valve seat being defined exclusively by exposed internal surface portions of said porous member;

a movable ball check in said valve chamber; and an imperforate dip tube secured at one end in said porous member to be in fluid communication with said valve chamber and extending from said porous element for the approximate interior height of the bottle to which said cap element is adapted to be fitted to an open distal end.

9. The apparatus recited in claim 8 wherein the interior diameter of said imperforate tube is smaller than the diameter of said ball check, thereby to retain said ball check in said valve chamber and wherein said one end of said dip tube is notched to prevent seating of said ball check against said dip tube.

10. The apparatus recited in claim 8 wherein said passageway is concentric with said porous member and extends throughout the length thereof between said inner and outer ends.

11. The apparatus recited in claim 10 wherein said passageway is shaped to establish an air return passage between said outer end and said valve seat, said air return passage being of small diameter relative to said valve chamber, and a counterbore extending from said valve chamber to said inner end.

12. The apparatus recited in claim 11 wherein said air return passage, said valve seat and said valve chamber are defined exclusively by exposed internal surface portions of said porous member.

* * * * *

UNITED STATES PATENT OFFICE

CERTIFICATE OF CORRECTION

Patent No. 3,985,271 Dated October 12, 1976

Inventor(s) Jack C. Gardner

It is certified that error appears in the above-identified patent and that said Letters Patent are hereby corrected as shown below:

Column 1, line 36, "formable" should be --foamable--.

Column 3, line 22, "ensuring" should be --ensuing--.

Column 3, line 33, "or" should be --of--.

Column 3, line 58, "an" should be --and--.

Column 7, line 1, after "element", --having a-- should be inserted.

Signed and Sealed this

Twenty-second Day of February 1977

[SEAL]

*Attest:*

RUTH C. MASON
*Attesting Officer*

C. MARSHALL DANN
*Commissioner of Patents and Trademarks*